US010978774B2

(12) United States Patent
Karhu et al.

(10) Patent No.: US 10,978,774 B2
(45) Date of Patent: Apr. 13, 2021

(54) RESONATOR AND FILTER COMPRISING THE SAME

(71) Applicant: Nokia Technologies Oy, Espoo (FI)

(72) Inventors: Kimmo Kalervo Karhu, Oulu (FI); Efstratios Doumanis, Dublin (IE)

(73) Assignee: Nokia Technologies OY, Espoo (FI)

( * ) Notice: Subject to any disclaimer, the term of this patent is extended or adjusted under 35 U.S.C. 154(b) by 0 days.

(21) Appl. No.: 16/464,951

(22) PCT Filed: Aug. 24, 2017

(86) PCT No.: PCT/EP2017/071386
§ 371 (c)(1),
(2) Date: May 29, 2019

(87) PCT Pub. No.: WO2018/099617
PCT Pub. Date: Jun. 7, 2018

(65) Prior Publication Data

US 2019/0312329 A1 Oct. 10, 2019

(30) Foreign Application Priority Data

Dec. 1, 2016 (EP) ..... 16201628

(51) Int. Cl.
*H01P 7/06* (2006.01)
*H01P 1/20* (2006.01)
*H01P 7/04* (2006.01)

(52) U.S. Cl.
CPC ..... *H01P 7/06* (2013.01); *H01P 1/20* (2013.01); *H01P 7/04* (2013.01)

(58) Field of Classification Search
CPC ..... H01P 3/121; H01P 3/122; H01P 3/127; H01P 5/12; H01P 11/002; H01P 3/165;
(Continued)

(56) References Cited

U.S. PATENT DOCUMENTS 4,292,610 A * 9/1981 Makimoto ..... H01P 7/04 331/107 C
4,380,747 A 4/1983 Curtinot et al.
(Continued)

FOREIGN PATENT DOCUMENTS

DE 10 2014 001917 A1 8/2015

OTHER PUBLICATIONS

Yong Wang et al., "Full Wave Design of a Reentrant Coaxial Filter by Using HFSS," Microwave Conference Proceedings, APMC2005 Proceedings, IEEE, vol. 5, pp. 1-3, XP010902598, 2005.
(Continued)

*Primary Examiner* — Robert J Pascal
*Assistant Examiner* — Kimberly E Glenn
(74) *Attorney, Agent, or Firm* — Fay Sharpe LLP

(57) ABSTRACT

A resonator (40) for a filter comprises (i) a cavity (49) having first and second opposing conductive end walls (41, 42) and a conductive side wall (43); (ii) a conductive post (44) extending into the cavity from the first conductive end wall, the end of the conductive post remote from the first conductive end wall being provided or integral with a hollow conductive element (45) which is flared and increases in cross-section in a direction towards the second conductive end wall; and (iii) a load element (47) extending into the cavity from the second conductive end wall, the load element being flared and decreasing in cross-section in a direction away from the second conductive end wall. The end of the load element remote from the second conductive end wall extends into the end of the hollow conductive element remote from the conductive post and forms an annular gap with the hollow conductive element. The resonator has improved power-handling compared to resonators of the prior art.

10 Claims, 5 Drawing Sheets

(58) Field of Classification Search
CPC ..... H01L 21/76877; H01L 21/823475; H01L 23/66; H01L 2223/6627; G02B 2006/1215; G02B 6/132; G02B 6/00; G02B 6/122; G02B 6/125
USPC ..... 333/127
See application file for complete search history.

(56) References Cited

U.S. PATENT DOCUMENTS

| | | | | |
|---|---|---|---|---|
| 6,600,393 | B1 * | 7/2003 | Pahlman | H01P 1/205 333/203 |
| 7,227,434 | B2 * | 6/2007 | Haraldsson | F16B 39/284 331/96 |
| 8,810,336 | B2 * | 8/2014 | Subedi | H01P 1/2053 333/203 |
| 2010/0283558 | A1 | 11/2010 | Panks et al. | |
| 2011/0241801 | A1 | 10/2011 | Subedi | |

OTHER PUBLICATIONS

Giuseppe Macchiarella et al., "Combine Filters using Conical Resonators," 33rd European Microwave Conference, IEEE, pp. 167-169, XP031069682, Munich 2003.

Robert J. Wenzel, "Synthesis of Combline and Capacitively Loaded Interdigital Bandpass Filters of Arbitrary Bandwidth," IEEE Transactions on Microwave Theory and Techniques, vol. MIT-19, No. 8, pp. 678-686, Aug. 1971.

Ke-Li Wu et al., "A Full Wave Analysis of a Conductor Post Insert Reentrant Coaxial Resonator in Rectangular Waveguide Combline Filters," IEEE, MTT-S Digest, pp. 1639-1642, 1996.

Evaristo Musonda et al., "Microwave Bandpass Filters Using Re-Entrant Resonators," IEEE Transactions on Microwave Theory and Techniques, vol. 63, No. 3, pp. 954-964, Mar. 2015.

International Search Report for PCT/EP2017/071386 dated Nov. 13, 2017.

* cited by examiner

RESONATOR AND FILTER COMPRISING THE SAME

FIELD OF THE INVENTION

The invention relates to filters for use in telecommunications, particularly RF filters.

BACKGROUND

For medium to high power filtering applications, such as within telecommunications applications for example, and particularly at the lower end of the microwave spectrum (e.g. ~700 MHz), cavity filters can be used. The performance characteristics of cavity filters dictates their size, and as a result they are typically one of the bulkiest and heaviest components within mobile cellular base stations.

A reduction in physical size of a cavity filter can result in poorer power handling because of a concomitant increase in electric field intensity within the filter during use.

SUMMARY

A first aspect of the present invention provides a resonator for a filter, the resonator comprising:

(i) a cavity having first and second opposing conductive end walls and a conductive side wall or conductive side walls;

(ii) a conductive post extending into the cavity from the first conductive end wall, the end of the conductive post remote from the first conductive end wall being provided or integral with a hollow conductive element which is flared and increases in cross-section in a direction towards the second conductive end wall; and (iii) a load element extending into the cavity from the second conductive end wall, the load element being flared and decreasing in cross-section in a direction away from the second conductive end wall;

wherein the end of the load element remote from the second conductive end wall extends into the end of the hollow conductive element remote from the conductive post and forms an annular gap with the hollow conductive element. A bottom part of the load element may be curved or convex.

For a given power input, a lower electric field intensity is produced within a resonator of the invention than within a prior art resonator of the same physical size. Equivalently, for a given input power, a resonator of the invention has a significantly smaller volume than a resonator of the prior art if the electric field intensity within the two resonators is the same. In other words a resonator of the invention has intrinsically better power-handling capability than a resonator of the prior art. Improvements are provided in both peak- and average-power handling.

The resonator may further comprise a second conductive post extending into the hollow conductive element from the end of the first conductive post remote from the first conductive end wall, the length of the second conductive post being adjustable to allow tuning of the resonant frequency of the resonator. The end of the load element remote from the second conductive end wall may be closed, for example the load element may be solid, or alternatively hollow and enclosing a void or space. The load element may be a dielectric load element or a conductive load element.

Alternatively, the load element may be a conductive load element and the resonator may further comprise a second conductive post extending into the cavity from the second conductive end wall and within the conductive load element, the length of the second conductive post within the cavity being adjustable to allow tuning of the resonant frequency of the resonator.

Alternatively, the end of the load element remote from the second conductive end wall may be a closed end of the load element and the resonator may further comprise a tuning post extending from the closed end of the load element and into the end of the hollow conductive element remote from the conductive post, the length of the tuning post extending from the closed end of the load element being adjustable to allow tuning of the resonant frequency of the resonator. The load element and the tuning post may both be either dielectric or conductive.

A terminal portion of the hollow conductive element remote from the first conductive post may extend directly towards the conductive side wall or conductive side walls of the cavity. Alternatively, a terminal portion of the hollow conductive element remote from the first conductive post may extend towards the first conductive end wall of the cavity. Alternatively, a terminal portion of the first hollow conductive element may have a first part which extends directly towards the conductive side wall or conductive side walls of the cavity and a second part which extends towards the first conductive end wall of the cavity. For a given input power, these configurations of the hollow conductive element each provide a further reduction in the electric field intensity within the resonator.

A second aspect of the invention provides a resonator for a filter, the resonator comprising:

(i) a cavity having first and second opposing conductive end walls and a conductive side wall or conductive side walls;

(ii) a conductive post extending into the cavity from the first conductive end wall, the end of the conductive post remote from the first conductive end wall being provided or integral with a hollow conductive element which is flared and increases in cross-section in a direction towards the second conductive end wall; and (iii) a load element extending into the cavity from the second conductive end wall, the load element being flared and decreasing in cross-section in a direction away from the second conductive end wall;

wherein the end of the load element remote from the second conductive end wall is an open end of the load element and the end of the hollow conductive element remote from the first conductive post extends into said open end and forms an annular gap with the load element.

A resonator according to the second aspect of the invention also has improved power-handling capabilities compared to resonators of the prior art.

The resonator may further comprise a second conductive post extending into the hollow conductive element from the end of the first conductive post remote from the first conductive end wall, the length of the second conductive post being adjustable to allow tuning of the resonant frequency of the resonator.

Alternatively, the resonator may further comprise a tuning post extending into the cavity from the second conductive end wall and within the load element, the length of the tuning post within the cavity being adjustable to allow tuning of the resonant frequency of the resonator, the load element and the tuning post both being either dielectric or conductive.

A third aspect of the invention provides a filter or an RF filter comprising a resonator according to either the first aspect of the invention or to the second aspect of the invention.

BRIEF DESCRIPTION OF THE DRAWINGS

Embodiments of the invention will now be described, by way of example only, with reference to the accompanying drawings, in which.

DESCRIPTION

Figure 1:
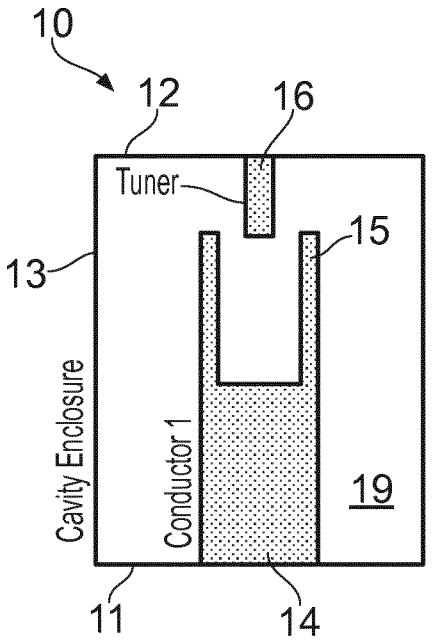
FIG. 1 (Prior Art)
FIG. 1 shows a longitudinal section of a combline resonator of the prior art.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

The inventors realised that some cavity filters can be based on the combline resonator and the re-entrant combline resonator respectively. Each of these resonators comprises a conductive cavity comprising first and second opposing conductive end walls and a conductive side wall or conductive side walls. In a combline resonator, a first conductive post extends into the cavity from the first conductive end wall, a terminal end portion of the first conductive post remote from the first conductive end wall being hollow. A second conductive post extends into the cavity from the second conductive end wall and into the vicinity of the terminal end portion of the first conductive post. The length of the second conductive post within the cavity is adjustable to allow tuning of the resonant frequency of the resonator. In a variant of the combline resonator, known as a 'hat' resonator, the hollow terminal end portion of the first conductive post can have an annular flange or rim extending laterally towards the conductive side wall or walls of the cavity. In a re-entrant combline resonator, a conductive post extends into the cavity from the first conductive end wall and a second conductive post extends into the cavity from the second conductive end wall, a terminal end portion of the second conductive post remote from the second end wall being hollow. The first conductive post extends into the terminal end portion of the second conductive post, thus forming an annular gap.

Figure 2:
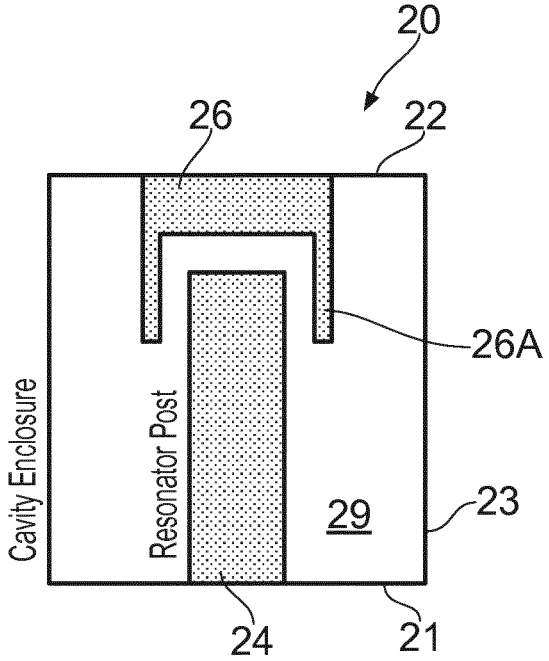
FIG. 2 (Prior Art)
FIG. 2 shows a longitudinal section of a re-entrant combline resonator of the prior art.
Figure 3:
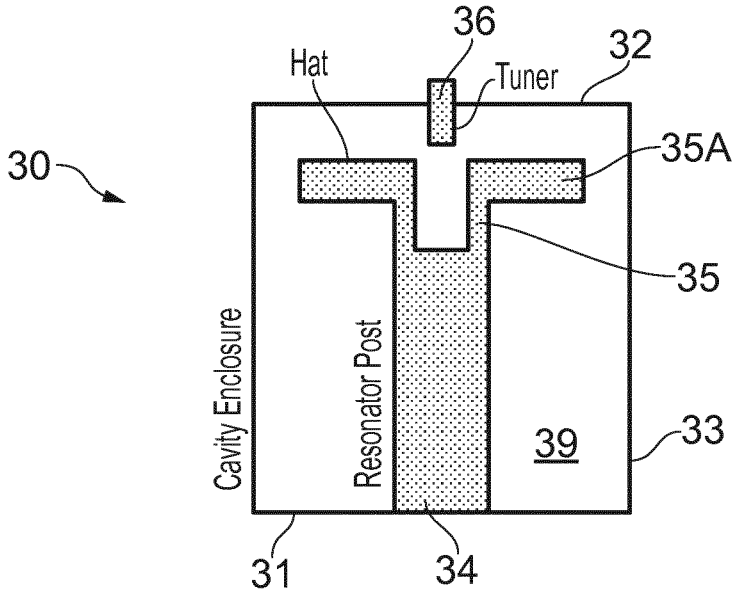
FIG. 3 (Prior Art)
FIG. 3 shows a longitudinal section of a 'hat' resonator of the prior art.

In these three known devices, shown in FIGS. 1-3, reducing the size of the resonator results in a higher electric field intensity in use of the resonator, and there is therefore a lower limit on the physical size of these filters due to power-handling considerations. Poor average power handling results in heating which can adversely affect Q-factor, whilst poor peak-power handling can also result in heating as well as electrical breakdown of air in a resonator.

In FIG. 1, a combline resonator 10 of the prior art comprises a cavity 19 having first 11 and second 12 opposing conductive ends walls and a conductive side wall 13. A first conductive post 14 extends into the cavity 19 from the first end wall 11. A second conductive post 16 extends into the cavity 19 from the second conductive end wall 12 and into the vicinity of a hollow terminal end portion 15 of the first conductive post 14, the length of the second conductive post 16 within the cavity being adjustable to allow tuning of the resonant frequency of the resonator.

In FIG. 2, a re-entrant combline resonator 20 of the prior art comprises a cavity 29 having first 21 and second 22 conductive end walls and a conductive side wall 23. A conductive post 24 extends into the cavity 29 from the first conductive end wall 21 and into a terminal portion 26A of a conductive element 26 which extends into the cavity 29 from the second conductive end wall 22, such that an annular gap is formed between the conductive post 24 and the conductive element 26.

FIG. 3 shows a variant of the combline resonator 10 of FIG. 1, namely a so-called 'hat' resonator 30 which comprises a cavity 39 defined by first 31 and second 32 conductive end walls and a conductive side wall 33. A first conductive post 34 extends into the cavity 39 from the first conductive end wall 31. A terminal portion 35 of the first conductive post 34 is hollow and an annular rim or flange 35A extends laterally from terminal end portion 35 towards the conductive side wall 33. A second conductive post 36 extends in to the cavity 39 from the second conductive end wall 32 and into the vicinity of the hollow terminal end portion 35. The length of the second conductive post 36 within the cavity 39 may be adjusted (e.g. the post 36 may be mounted by screw threads in the second conductive end wall) to provide tuning of the resonant frequency of the resonator 30.

The inventors realised that the extent to which the resonators 10, 20, 30 can be reduced in size for a given power input is significantly limited by the electric field intensities arising within the resonators in use, which increase as their respective volumes decrease.

Figure 4:
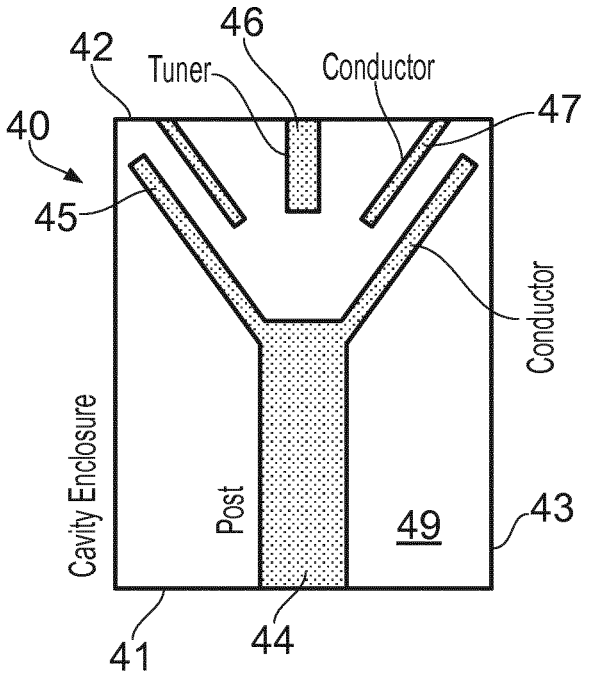
FIGS. 4 to 16 each show a longitudinal section of a respective resonator according to example embodiments.

We now turn to describe embodiments of the invention. FIG. 4 shows a longitudinal section through a first example resonator, indicated generally by 40. Resonator 40 has a cavity 49 having first 41 and second 42 opposing conductive end walls and a conductive side wall 43. The transverse shape of the cavity 49, i.e. its shape in the plane perpendicular to the plane of FIG. 4 may be rectangular or circular or elliptical or any one of a number of other shapes. A first conductive post 44 extends into the cavity 49 from the first conductive end wall 41. A first flared, hollow conductive element 45 extends from the end of the first conductive post 44 remote from the first conductive end wall 41 and has a transverse cross-section which increases in a direction towards the second conductive end wall 42. In other words, element 45 diverges in a direction towards the second conductive end wall 42. The element 45 has the form of a truncated cone, however in alternative embodiments the shape of the flared, hollow conductive element in longitudinal cross-section may be curved rather than linear as shown in FIG. 4.

In an example, the hollow conductive element 45 diverges in a direction towards the second conductive end wall 42 by one or more different degrees or amounts. For example, the degree of divergence can be stepped or varied so that it increases (or decreases) the closer the element 45 gets to the conductive end wall 42. The variation in divergence can be continuous or can be provided in discrete steps.

A second flared, hollow conductive element 47 extends into the cavity 39 from the second conductive end wall 42 and into the end of the first flared, hollow conductive element 45 remote from the first conductive post 44 and is spaced apart from the element 45, thus forming an annular gap where the elements 45, 47 overlap. The element 47 is also flared (conical) and has a transverse cross-section which increases in a direction towards the second conductive end wall 42, i.e. element 47 diverges in a direction towards the second conductive end wall 42.

In an example, the degree or variation of the flare (or convergence from the second conductive end wall 42) of the hollow conductive element 47 can be matched to the convergence of the hollow conductive element 45. That is, the shape of the conductive elements 45, 47 can be matched or so profiled as to maintain substantially the same width of annular gap where the elements 45, 47 overlap. The hollow conductive element 47 may be so profiled as to match the profile of the element 45 in the case that it diverges continuously or in degrees as described above.

A second conductive post 46 extends into the cavity 49 from the first conductive end wall 42, within and spaced apart from the element 47. The length of the second conductive post 46 within the cavity 49 is adjustable to allow tuning of the resonant frequency of the resonator 40. The second flared, hollow conductive element 47 provides additional capacitance between the first 44 and second 36 conductive posts.

The performance of the resonator 40 and that of a prior art 'hat' resonator such as 30 of the same physical size have been modelled using CST Microwave Studio® software. The Q-factor of the resonator 40 was found to have a value of 2845 compared to a value of 2827 for the prior art resonator, at 886 MHz and 885 MHz respectively. However, the electric field intensity within the resonator 40 was 40% of that within the prior art resonator.

Figure 5:
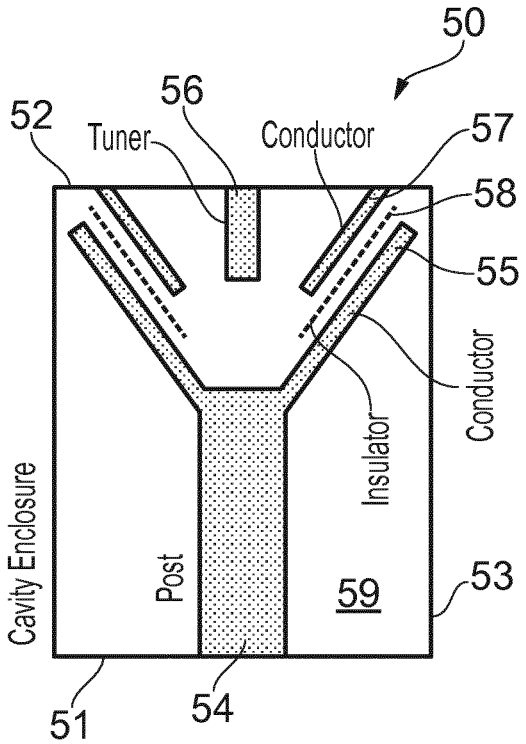

FIG. 5 shows a longitudinal section of second example resonator 50. Parts of the resonator 50 are labelled with reference signs differing by 10 from those labelling corresponding parts of the resonator 40 of FIG. 4. A conical dielectric element 58 is interposed between the first and second flared, hollow conductive elements 55, 57.

Figure 6:
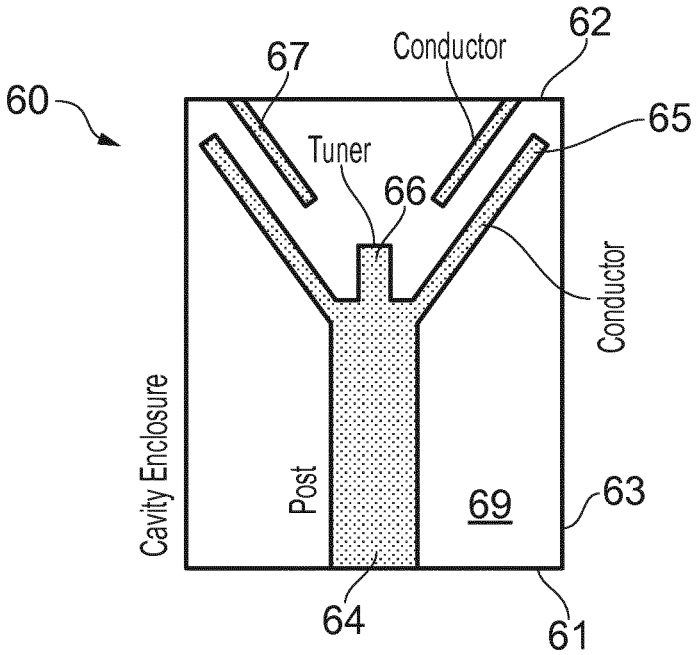

FIG. 6 shows a longitudinal section through a third example resonator 60 which is similar to the resonator 40 of FIG. 4. Parts of the resonator 60 are labelled with reference signs differing by a value of 20 from those labelling corresponding parts of the resonator 40 of FIG. 4. In the resonator 60, a second conductive post 66 extends into a first flared, hollow conductive element 65 from the end of first conductive post 64 remote from first conductive end wall 61, the length of the second conductive post 66 being adjustable to allow tuning of the resonant frequency of the resonator 60.

Figure 7:
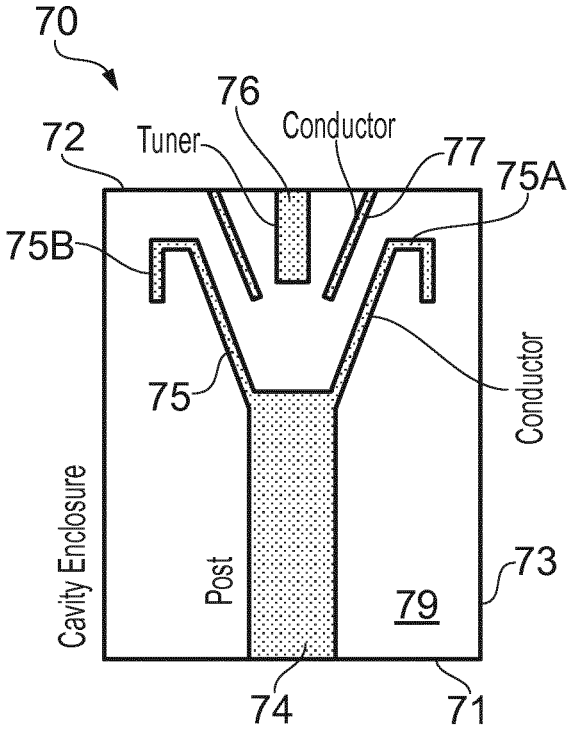
Figure 8:
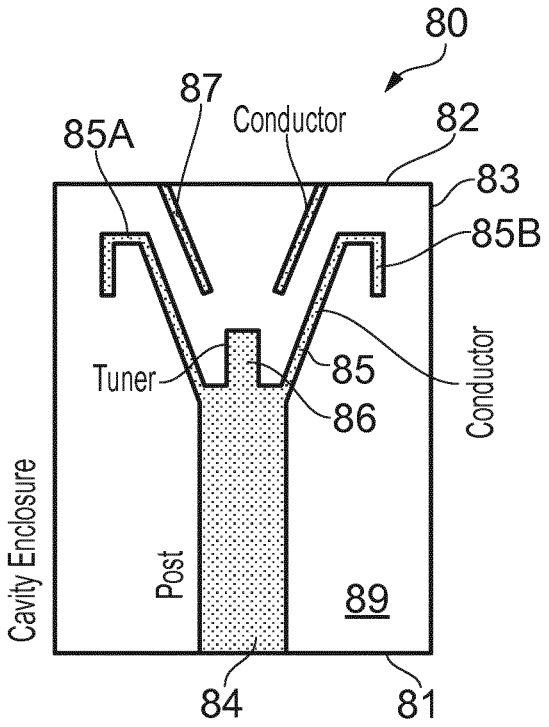

FIGS. 7 and 8 show longitudinal sections through fourth 70 and fifth 80 example resonators of the invention respectively. The resonator 70 of FIG. 7 is similar to the resonator 40 of FIG. 4; parts of the resonator 70 are labelled with reference signs which differ by a value of 30 from those labelling corresponding parts in FIG. 4. In the resonator 70, a first conductive post 74 extends into cavity 79 and is provided or integral with a first flared, hollow conductive element 75 at an end of the first conductive post 74 remote from first conductive end wall 71. The element 75 diverges towards second conductive end wall 72 and has a terminal end portion having a first part 75A which extends directly towards conductive side wall 73 and a second part 75B which extends back towards the first conductive end wall 71 of the cavity 79.

The resonator 80 of FIG. 8 is similar to the resonator 60 of FIG. 6; parts of the resonator 80 are labelled with reference signs differing by 20 from those labelling corresponding parts in FIG. 6. The resonator 80 has a first conductive post 84 extending from a first conductive wall 81 into a cavity 89, the first conductive post 84 being provided or integral with a first flared, hollow conductive element 85 having a terminal end portion having a first part 85A which extends directly towards the conductive side wall 83 and a second part 85B which extends towards the first conductive end wall 61.

The parts 75A, 75B of the resonator 70 and the parts 85A, 85B of the resonator 80 serve to further reduce the electric field intensities within the cavities 79, 89 compared to the electric field intensities within cavities 49, 69 of resonators 40, 60 of the same volume, for the same input power. Equivalently, for a given power input and a given electric field intensity the resonators 70, 80 have a smaller volume than those of the resonators 40, 60.

Figure 9:
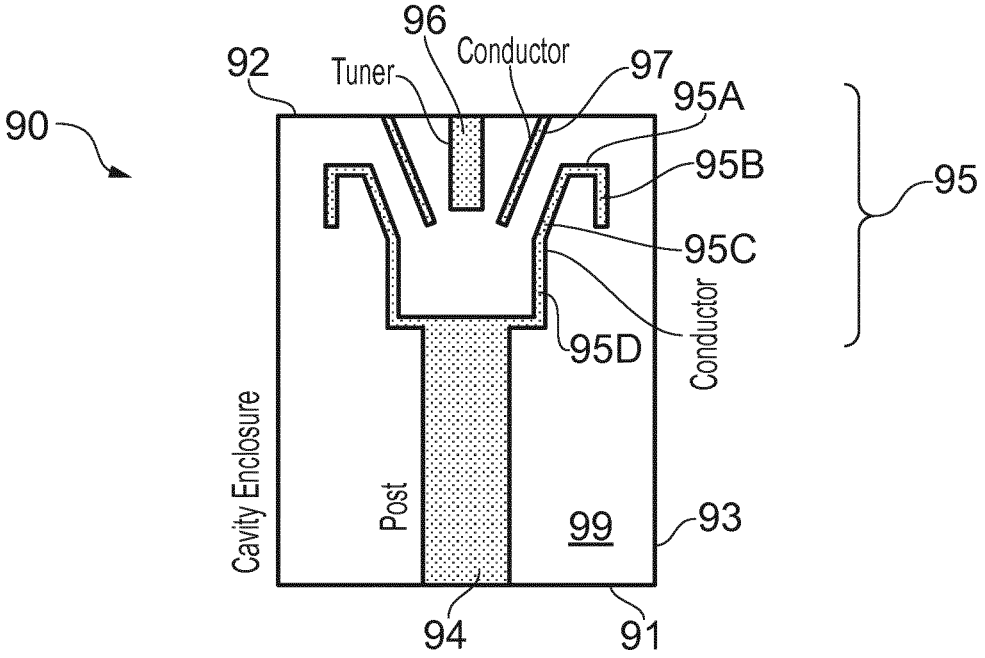

FIG. 9 shows a longitudinal section of a sixth example resonator 90 which is similar to the resonator 70 of FIG. 7; parts of the resonator 90 are labelled with reference signs differing by 20 from those labelling corresponding parts in FIG. 7. In the resonator 90, first, flared hollow conductive element 95 has two parts 95C, 95D which diverge at different rates in a direction towards second conductive end wall 92.

Figure 10:
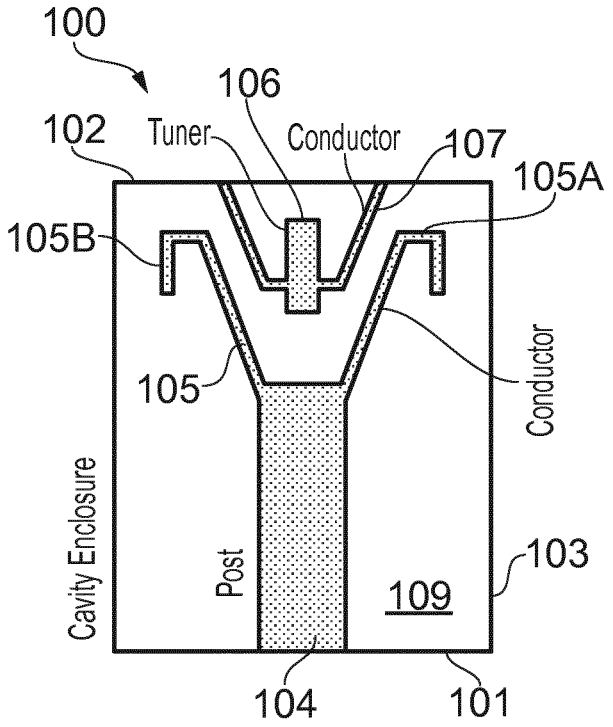
Figure 11:
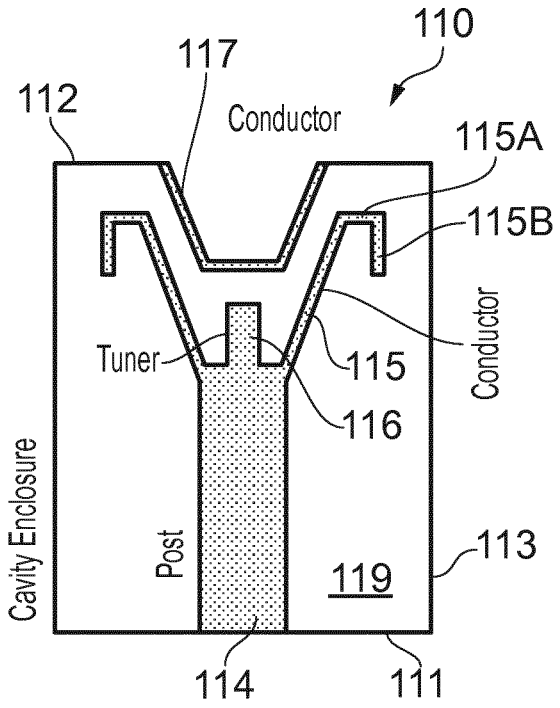

FIGS. 10 and 11 show longitudinal sections of seventh 100 and eighth 110 example resonators of the invention, respectively. Resonator 100 of FIG. 10 is similar to resonator 70 of FIG. 7. Parts of the resonator 100 are labelled with reference signs differing by 30 from those labelling corresponding parts in FIG. 7. The resonator 100 has a second hollow, flared conductive element 107 extending from second conductive end wall 102, the end of the element 107 remote from the second conductive end wall 102 being closed. A second conductive post 106 is mounted on the closed end of the element 107 remote from the second conductive end wall 102 and extends into the end of first flared, hollow conductive element 105 remote from the first conductive post 104. The length of the second conductive post 106 which extends into this end of the first, flared, conductive element 105 is adjustable to allow tuning of the resonant frequency of the resonator 100. In a variant of the resonator 100, parts 106 and 107 are both dielectric, for example ceramic having a relative permittivity of about 8 to 50 and/or the element 107 may be solid, except for a bore to accommodate post 106.

Resonator 110 in FIG. 11 is similar to the resonator 80 in FIG. 8. Parts of the resonator 110 are labelled with reference signs differing by 30 from those labelling corresponding parts in FIG. 8. In the resonator 110, a second flared, hollow conductive element 117 extends into cavity 119 from a second conductive end wall 112 and into the end of a first flared, hollow conductive element 115 remote from a first conductive post 114. Element 117 is integral with the second conductive end wall 112. The length of a second conductive post 116 which extends into the first flared, hollow conductive element 115 from first conductive post 114 may be adjusted to allow tuning of the resonant frequency of the resonator 110. The end of element 117 remote from second conductive end wall 112 is a closed end of element 117.

Figure 12:
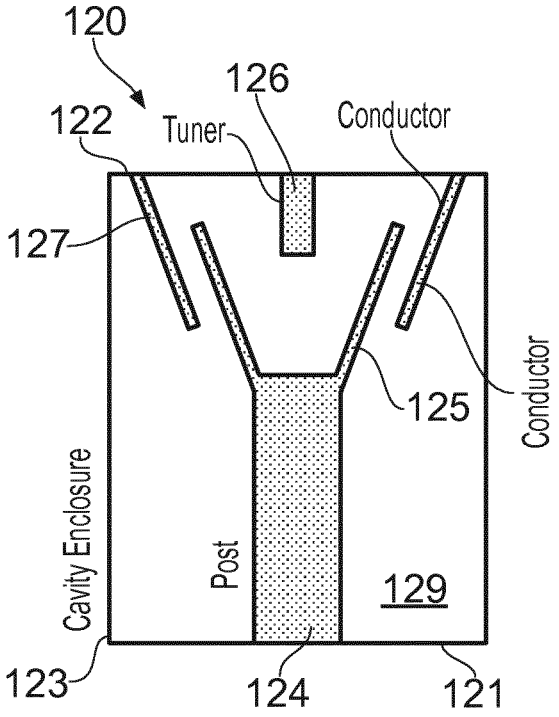

FIG. 12 shows a ninth example resonator indicated generally by 120. The resonator 120 comprises cavity 129 having first 121 and second 122 opposing conductive end walls and a conductive side wall 123. A first conductive post 124 extends into the cavity 129 from the first conductive end wall 121. The end of the first conductive post 124 remote from the first conductive end wall 121 is provided or integral with a first flared, hollow conductive element 125 which diverges (i.e. increases in cross-section) in a direction towards the second conductive end wall 122. A second, flared hollow conductive element 127 extends into the cavity 129 from the second conductive end wall 92 and converges (i.e. decreases in cross-section) in a direction towards the first conductive end wall 121. The element 125 extends from the first conductive post 124 into the end of element 127 remote from the second conductive end wall 122 and forms an annular gap with the element 127 where the elements 125, 127 overlap. A second conductive post 126 extends into the cavity 129 from the second conductive end wall 122, within and spaced apart from the element 127. The length of the second conductive post 126 within the cavity 129 is adjustable to allow tuning of the resonant frequency of the resonator 120.

Figure 13:
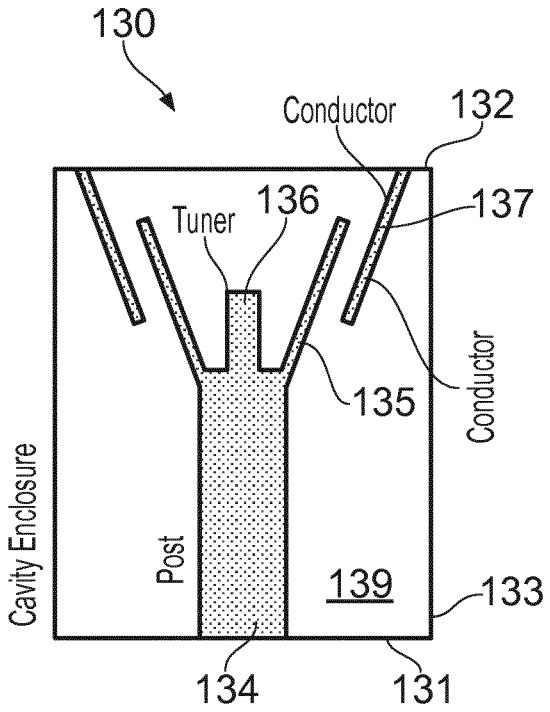

FIG. 13 shows an tenth example resonator indicated generally by 130. The resonator 130 is similar to the resonator 120 of FIG. 12; parts of the resonator 130 are labelled with reference signs differing by 10 from those labelling corresponding parts in FIG. 12. In the resonator 130, a second conductive post 136 extends into first, hollow, flared conductive element 135 from first conductive post 134. The length of the second conductive post 136 extending from the first conductive post 134 is adjustable to allow tuning of the resonant frequency of the resonator 130.

Figure 14:
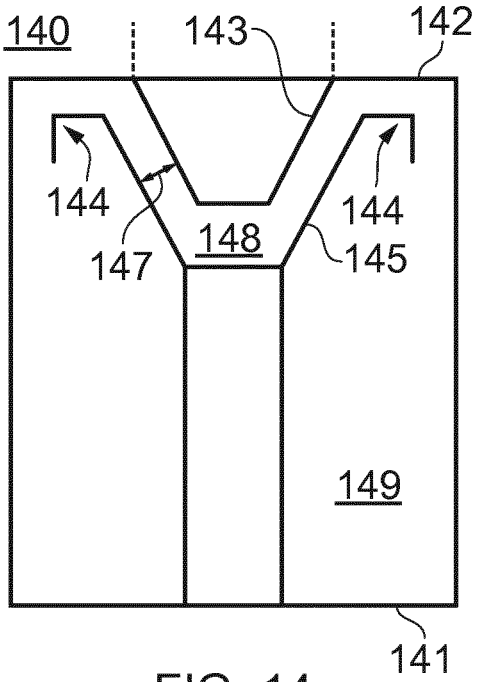

FIG. 14 shows an eleventh example resonator indicated generally by 140. The resonator 140 is broadly similar to the resonators 100 (FIG. 10) and 110 (FIG. 11) with the exception that a separate tuner (106 and 116 in FIGS. 10 and 11 respectively) is not present. According to the example of FIG. 14, a load element 143 acts as both a tuner and a conductor. That is, the load element 143 can be used to fine tune the response of the resonator, and is also structurally configured to maximise the space used in the resonator for 'trapping' an electric field.

The element 143 of FIG. 14 is in the form of a truncated cone (frustum of a cone) that extends into the cavity 149 from the second conductive end wall 142 and converges (i.e. decreases in cross-section) in a direction towards the first conductive end wall 141 of the resonator 140. Other shapes may be selected for element 143 as will be described in more detail below. The element 143 may be hollow or solid.

The width of the annular gap 147 where the element 143 overlaps with the conductor 145 can be adjusted using the element 143. For example, the degree to which the element 143 extends into the cavity 149 from the second conductive end wall 142 in a direction towards the first conductive end wall 141 can be varied. This may be effected using a screw thread on element 143 that can be used to adjust the position of the element 143 from outside of the cavity 149.

According to the example shown in FIG. 14, the load element 143 is flared and decreases in cross-section in a direction away from the second conductive end wall 142. In an example, the external profile or shape of the load element 143 can match the internal shape or profile of the conductor 145, thereby enabling a substantially even annular gap 147 to be provided, giving improved electric field distribution and energy storage. In another example, the external profile or shape of the load element 143 may differ from the internal shape or profile of the conductor 145 resulting in an irregular gap where the element 143 overlaps with the conductor 145.

When compared with, for example, the prior art resonators of FIGS. 1 and 3, the load element 143 fills a relatively larger volume within the conductor 145. Accordingly, in use of the resonator, a larger useable volume is provided for stored energy compared to prior art systems in which there is little to no electric field present in the bottom half of the conductor cavity. Since a relatively small change in the position of the tuner results in a large variation in the properties of the resonator, the tuners 16, 36 for example have a maximum degree of travel in a direction away from wall 12, 32 that precludes the tuner from entering the cavity defined by the conductors to any significant degree. Accordingly, there is a relatively large volume of the cavities defined by the conductors that are devoid of electric field.

In the example of FIG. 14, the load element 143 is so sized and shaped as to provide an annular gap 147, which, broadly speaking, forms a channel 148 defined by the space between the load element 143 and the conductor 145. The channel extends out from the conductor 145 such that it is defined by the space between the lips 144 of the conductor 145 and the uppermost inner part of the cavity 149. The channel 148 therefore extends over a large volume. This enables the volume within a conductor 145 to be utilised in a much more efficient way, thereby increasing the peak power handling capabilities of a filter using the resonator(s). Put another way, the useable volume of the resonator defined by the combination of the load element 143 and the conductor 145 is maximised by using the load element 143 and conductor 145 to define an annular gap in the form of the channel 148 capable of storing electric charge over a much larger volume than has previously been the case. Thus, the useable volume of the resonator is extended by the combination of the load element 143 and the larger volume of the conductor 145 as well as the extension provided by the lips 144 and the cavity 149 itself.

As indicated by the dotted lines in FIG. 14, which represent a screw thread of the load element 143, the degree to which the load element 143 can extend in to the cavity 149 can be adjusted from outside of the cavity 149.

Figure 15:
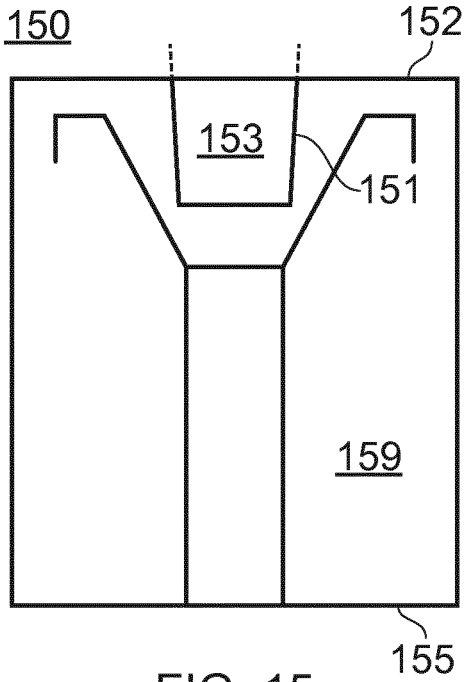

FIG. 15 shows a twelfth example resonator indicated generally by 150. The resonator 150 is broadly similar to the resonator 140 (FIG. 14). According to the example of FIG. 15, a load element 153 acts as both a tuner and a conductor. In the example of FIG. 15, the load element 153 is in the form of a frustum of a (right circular) cone, similarly to that of FIG. 14. However, as noted above, and in common with the load element 143 of FIG. 14, the cone need not be a frustum of a circular cone, but may, for example, be a frustum of a pyramidal or oblique cone and so on. Alternatively, a load element may be cuboid or trapezoidal prism.

In the example of FIG. 15, the outer face 151 of the load element 153 has a less pronounced slope than that of the load element 143, although there is still a degree of flaring towards the second conductive end wall 152. Thus, similarly to FIG. 14, the load element 153 extends into the cavity 159 from the second conductive end wall 152 and converges (i.e. decreases in cross-section) in a direction towards the first conductive end wall 155 of the resonator 150. Similarly to the case in FIG. 14, the degree to which the load element 153 extends in to the cavity 159 can be adjusted or fine-tuned using a screw thread. In an example, the load element 143, 153 is in the form of screw that extends through the cavity enclosure of a resonator such that the lower portion, which is within the cavity of the resonator, acts as the load element. Accordingly, in the examples of FIGS. 14 and 15, the portion of the load element 143, 153 depicted is part of a larger item.

Figure 16:
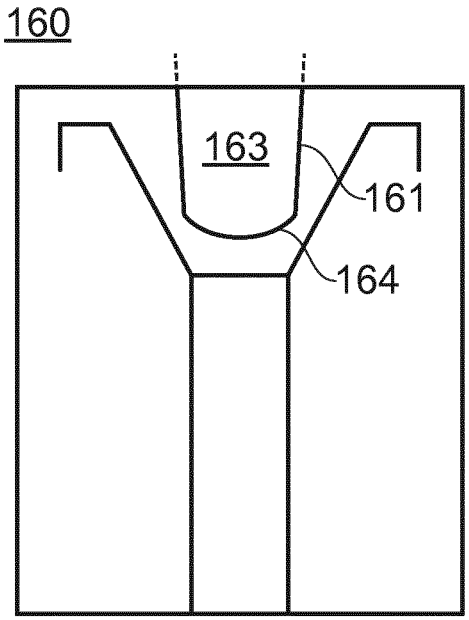

FIG. 16 shows a thirteenth example resonator indicated generally by 160. The resonator 160 is the same as the resonator 150 (FIG. 15) except that the bottom part of the load element 163 is curved (164). For example, the bottom part 164 in the example of FIG. 16 is convex.

In an example, a load element as described with reference to any of FIGS. 14 to 16 may not be flared. In another example, a load element as described with reference to any of FIGS. 14 to 16 may be flared only over a portion thereof. For example, with reference to FIG. 16 for example, the side wall 161 may not be flared, such that the load element is in the form of a cylinder (for example) with a convex bottom part 164.

According to an example, a load element as described herein has a transverse cross-section which increases in a direction towards a second conductive end wall. In other words, a load element diverges or widens in a direction towards a second conductive end wall 42. In an example, a load element is ever-widening (or ever-narrowing depending on the basis for reference). That is, the side wall (e.g. 151, 161) of a load element is not vertical or parallel to the side walls of the cavity enclosure at any point along the length of the load element disposed within the cavity enclosure. It is therefore continuously narrowing (towards a first conductive end wall or away from a second conductive end wall) or widening (towards a second conductive end wall or away from a first conductive end wall).

A filter according to an example can comprise multiple resonators as described above. The resonators may be of the same type, or there may be a mixture of two or more different resonators within the filter.

Each of the resonators of FIGS. 4 to 13 may be used as a filter; typically input and output excitation conductors would be included within the cavity of a resonator to provide input and output paths.

The invention claimed is:

1. A resonator for a filter, the resonator comprising:

a cavity having first and second opposing conductive end walls and a conductive side wall or conductive side walls;

a conductive post extending into the cavity from the first conductive end wall, the end of the conductive post remote from the first conductive end wall being provided or integral with a hollow conductive element which is flared and increases in cross-section in a direction towards the second conductive end wall; and a load element extending into the cavity from the second conductive end wall, the load element having a closed end portion which is convex, the end portion decreasing in cross-section in a direction away from the second conductive end wall;

wherein the end of the load element remote from the second conductive end wall extends into the end of the hollow conductive element remote from the conductive post and forms an annular gap with the hollow conductive element.

2. A resonator according to claim 1 wherein the resonator further comprises a second conductive post extending into the hollow conductive element from the end of the first conductive post remote from the first conductive end wall, the length of the second conductive post being adjustable to allow tuning of the resonant frequency of the resonator.

3. A resonator according to claim 1 wherein the end of the load element remote from the second conductive end wall is a closed end of the load element.

4. A resonator according to claim 1 wherein the load element is a dielectric load element or a conductive load element.

5. A resonator according to claim 1 wherein the load element is a conductive load element wherein the resonator further comprises a second conductive post extending into the cavity from the second conductive end wall and within the conductive load element, the length of the second conductive post within the cavity being adjustable to allow tuning of the resonant frequency of the resonator.

6. A resonator according to claim 1 wherein a terminal portion of the hollow conductive element remote from the first conductive post extends directly towards the conductive side wall or conductive side walls of the cavity.

7. A resonator according to claim 1 wherein a terminal portion of the hollow conductive element remote from the first conductive post extends towards the first conductive end wall of the cavity.

8. A resonator according to claim 1 wherein a terminal portion of the first hollow conductive element has a first part which extends directly towards the conductive side wall or conductive side walls of the cavity and a second part which extends towards the first conductive end wall of the cavity.

9. A filter or an RF filter comprising a resonator according to claim 1.

10. A resonator according to claim 1, in which the load element is cylindrical.

* * * * *